US006178659B1

(12) United States Patent
Corner et al.

(10) Patent No.: US 6,178,659 B1
(45) Date of Patent: Jan. 30, 2001

(54) VACUUM APPARATUS FOR MULTIPLE-BED INDUSTRIAL HIDE DRIERS, AND DRIER INCLUDING THE APPARATUS

(75) Inventors: Antonio Corner, deceased, late of Thiene, by Elena Torresini, heiress; by Maria Luisa Corner, heir, Vicenza; by Carlo Corner, heir, Thiene; by Antonia Maria Corner, heir, Mussolente; by Paola Corner, heir, Padua; by Laura Corner, heir, Vicenza, all of (IT)

(73) Assignee: Officine di Cartigliano S.p.A. (IT)

( * ) Notice: Under 35 U.S.C. 154(b), the term of this patent shall be extended for 0 days.

(21) Appl. No.: 08/525,570

(22) PCT Filed: Mar. 14, 1994

(86) PCT No.: PCT/EP94/00788

§ 371 Date: Aug. 26, 1997

§ 102(e) Date: Aug. 26, 1997

(87) PCT Pub. No.: WO94/21828

PCT Pub. Date: Sep. 29, 1994

(30) Foreign Application Priority Data

Mar. 18, 1993 (IT) ..... MI93A0041

(51) Int. Cl.[7] ..... F26B 13/30
(52) U.S. Cl. ..... 34/92; 34/77; 34/75
(58) Field of Search ..... 34/92, 73, 74, 34/75, 77

(56) References Cited

U.S. PATENT DOCUMENTS 3,027,651 4/1962 Nerge .
3,302,303 * 2/1967 Aupoix ..... 34/217
3,987,556 * 10/1976 Tissot et al. ..... 34/217
5,033,206 * 7/1991 Corner ..... 34/92
5,056,239 * 10/1991 Corner ..... 34/92
5,184,487 * 2/1993 Corner ..... 69/19.1
5,288,471 * 2/1994 Corner ..... 422/307

FOREIGN PATENT DOCUMENTS 2557888 7/1898 (FR) .

* cited by examiner

*Primary Examiner*—Henry Bennett
*Assistant Examiner*—Pamela A. Wilson
(74) *Attorney, Agent, or Firm*—R. Neil Sudol; Henry D. Coleman

(57) ABSTRACT

A vacuum apparatus for industrial hide driers with multiple beds (2) includes a circuit with an open end (17) having arranged in a series: a vapor manifold (7) for each bed; a first condenser (8) inserted in each manifold; a first condensate separator (10) at the output of the various condensers (8); a main vacuum pump (16) to gradually reduce the absolute pressure in the circuit to a first upper value ($P_s$). A particular feature of the system consists of the fact that it has a secondary aspiration device (19) which is arranged upstream of the main vacuum pump (16) to operate in series to this pump when the first value of the absolute pressure ($P_s$) is reached, so as to further reduce the pressure of the circuit to a second lower value ($P_i$). The upper value ($P_s$) of the absolute pressure is 40 to 100 mbar; the second lower value ($P_1$) of the absolute pressure is 15 to 1 mbar. The device (19) is a high-capacity, low-head blower.

14 Claims, 1 Drawing Sheet

VACUUM APPARATUS FOR MULTIPLE-BED INDUSTRIAL HIDE DRIERS, AND DRIER INCLUDING THE APPARATUS

CROSS-REFERENCE TO RELATED APPLICATIONS

This is a 371 of PCT/EP94/00788 filed on Mar. 14, 1994.

BACKGROUND OF THE INVENTION

1. Field of the Invention

The present invention relates to a vacuum apparatus for multiple-bed industrial hide driers, and to a drier that includes the apparatus.

2. Description of the Related Art

It is known that the vacuum method of drying hides has, with respect to conventional methods that entail laying the hides on frames placed in ventilated and dehumidified rooms or in heated tunnels, the advantage of a hide that is smoother and flatter and also better adaptable to the subsequent finishing operations. Furthermore it allows shorter drying times, on the order of minutes instead of hours, and lower labor costs. Finally, modern driers entail lower energy consumption and occupy far less space than barometric-pressure systems.

However, vacuum driers have the drawback of higher initial and running costs and of lower final hide quality, especially for thinner hides with finer grain, due to the considerable heat-induced stresses on the hides and to the depletion of fatty materials contained in their fibers. In vacuum driers, the hides are in fact arranged on beds which are heated to approximately 60–80° C., i.e. to temperatures that are considerably higher than the "body" temperature of the animals from which they are obtained, in order to make the residual moisture evaporate as quickly as possible. In order to lower the evaporation temperature, the beds are hermetically enclosed by airtight lids so as to form a series of evaporation chambers that are connected to a vacuum pump by means of a circuit along which one or more condensers and/or condensate separators are arranged as shown in FR-A-2557888. The vapor state diagram clearly shows that the higher the vacuum produced in the sealed chambers, the lower the evaporation temperature at equilibrium.

For this purpose a high vacuum is produced in the vapor circuit by means of vacuum pumps of the liquid-ring type or of the variable-chamber cylinder type, using water or oil as working fluids; these pumps can produce vacuum up to 95% with residual absolute pressures of less than 30 mbar.

In practice, the pressure is gradually reduced down to a vacuum of more than 90%, which corresponds to an absolute pressure of approximately 80 mbar, with a vapor equilibrium temperature of approximately 45° C. Accordingly, the beds are heated to a temperature of at least 60–70° C. to produce a thermal gradient that allows evaporation of the residual moisture of the hides in an acceptable time. In order to reduce the evaporation time it is obviously possible to increase the temperature of the beds to more than 80° C. so as to increase the thermal gradient and thus the transfer of heat toward the hides, but this entails the risk of creating irreparable damage to their fibers.

Furthermore, in these conditions, and by cooling the condensers with water at a temperature of approximately 15° C., it is possible to dry the hides to a residual moisture content of approximately 30%. In order to provide more intense drying it is necessary to extend the time for which the hides remain on the beds, negatively affecting both the productivity of the apparatus and the quality of the dried product.

U.S. Pat. No. 3,027,651 describes an apparatus for removing condensable vapors including a Roots-type compressor arranged upstream of of a two-step condenser and of a gas ballast press. The compressor acts on the vapors as a supercharger to a low-temperature condenser unit operating between −20° C. and −40° C.

BRIEF SUMMARY OF THE INVENTION

The aim of the present invention is to eliminate the drawbacks described above by providing an apparatus with lower evaporation temperatures than in the conventional types, with obvious advantages from the point of view of production.

An object of the invention is to drastically reduce the evaporation temperature and consequently the temperature of the beds, so as to avoid any damage to the hides and give them maximum grain softness, with obvious advantages from the point of view of quality.

The invention achieves this aim and this object by means of a vacuum apparatus for industrial hide driers, including a circuit with an open end and having arranged in series: at least one manifold associated with each bed to collect the vapors released by the hides; a first condenser inserted in each manifold; a first condensate separator at the output of the various condensers; at least one main vacuum pump which is suitable to reduce the absolute pressure in the circuit to a first upper value which corresponds to a given vapor equilibrium temperature; characterized in that it has a secondary aspiration device which is arranged upstream of the main vacuum pump, said device operating in series to the vacuum pump when the first upper value of the absolute pressure is reached, said device being suitable to further reduce the absolute pressure to a second lower value that allows to instantly increase the evaporation and/or reduce the vapor equilibrium temperature to a second value which is lower than the first one.

With a vacuum system of the type specified above it is possible to drastically reduce drying times with respect to those of the past, with relatively low evaporation temperatures.

As an alternative, it is possible to significantly reduce the temperature of the beds, improving the final quality of the hides without negatively affecting the evaporation times.

It may also be possible to combine the above described effects, reducing both the evaporation times and the bed temperatures, with positive results in terms of both productivity and quality of the dried hides.

Preferably, the upper value of the absolute pressure reached by the main vacuum pump in the steady state is 100 to 40 mbar.

The lower value of the absolute pressure reached in the steady state by placing the secondary aspiration device in series to the main pump can be of 15 to 1 mbar.

Conveniently, the secondary aspiration device is of the high-capacity, low-head type, with an average capacity of 300 to 1000 $m^3/h$ and a pressure differential of 30 to 100 mbar.

The secondary aspiration device can be constituted by a positive-displacement compressor of the Roots or vane type or by a gas or steam ejector.

Advantageously, the intake and delivery ducts of the secondary aspiration device are connected by a bypass circuit with a controlled electric valve interposed.

In operation, the secondary aspiration device runs continuously: the electric valve of the bypass circuit is normally open when the absolute pressure in the circuit is higher than the first upper value and is closed for equal or lower values.

BRIEF DESCRIPTION OF THE DRAWING

Further characteristics and advantages will become apparent from the detailed description of a preferred but not exclusive embodiment of the vacuum apparatus according to the invention, illustrated only by way of non-limitative example with reference to the accompanying drawing, wherein the only FIGURE is a schematic view of a vacuum apparatus according to the invention, connected to a conventional drier.

Figure 1:
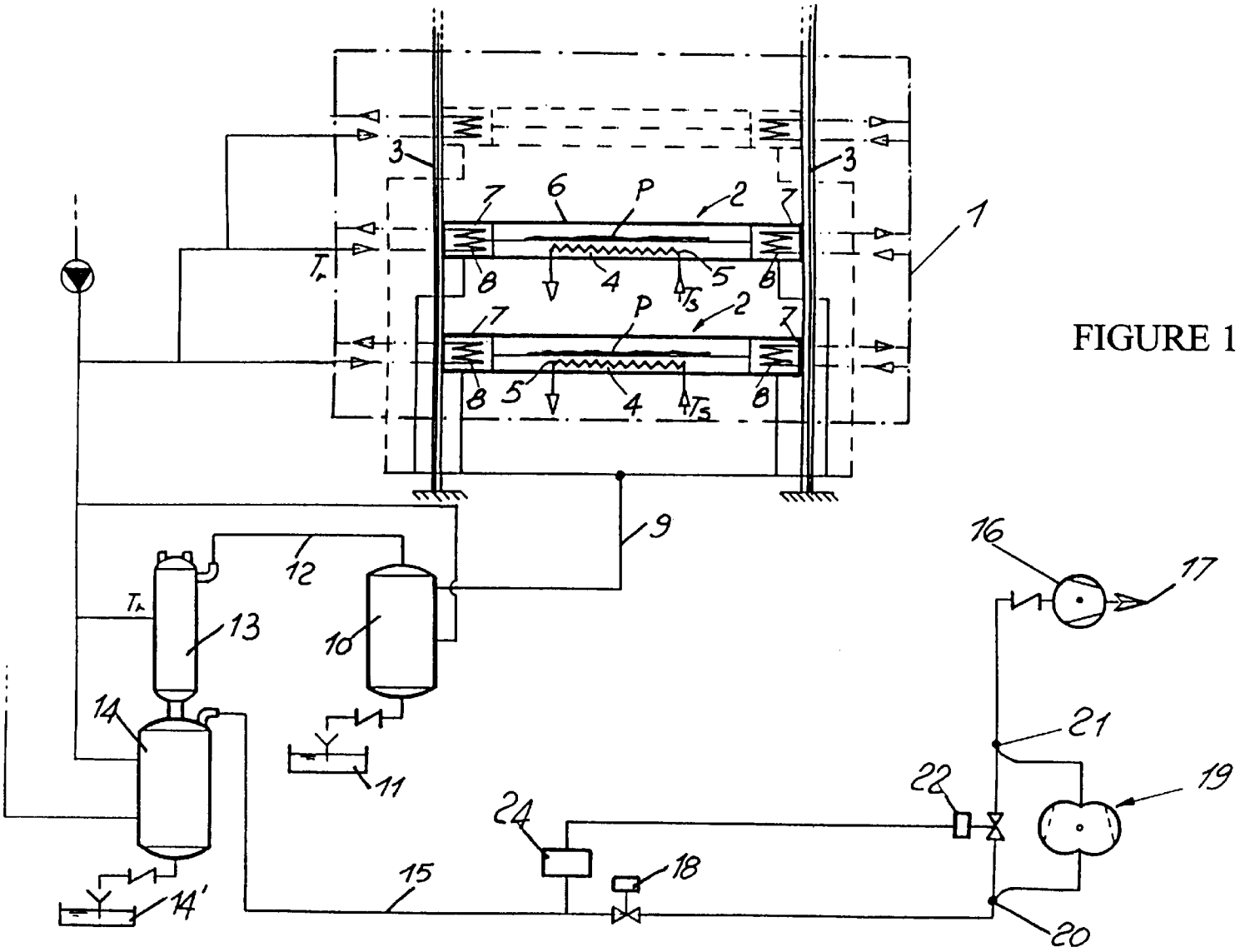
With reference to FIG. 1, the block 1 schematically designates a conventional drier with multiple beds which includes a series of stacked beds 2 that can move along vertical guides 3 of a frame which is anchored to the ground.

Each bed includes a lower part 4 and an upper cover 6 that closes hermetically. The lower part 4 is for heating hides P by means of coils 5, through which a fluid flows at a temperature $T_s$ which is higher than the ambient temperature.

At least one, preferably two steam manifolds 7 are associated with each bed. Respective condensers 8, constituted by coils through which a cooling fluid flows at a temperature $T_r$, are inserted in the manifolds.

The humid and partially condensed vapors at the outlet of the condensers 8 are conveyed by means of a main pipe 9 toward a first condensate separator 10, for example of the centrifugal type, with a condensate collection tray 11.

The vapor that leaves the separator 10 is conveyed along the line 12 to a second condenser 13 and then to a second condensate separator 14 with a collection tray 14'. The condenser 14 allows to almost entirely eliminate the residual humidity that is present in the circuit, where dry air flows almost exclusively from this point onward.

DESCRIPTION OF THE PREFERRED EMBODIMENTS

The separator 14 is connected, by means of a pipe 15, to a main vacuum pump 16, for example of the liquid-ring type with one or two stages, marketed and manufactured by Robuschi SpA under the trademark RVM. The pump 16 has the purpose of drawing the fluid toward the open end 17 of the circuit and of gradually reducing the absolute pressure of the fluid to a first upper value $P_s$ which is between 100 mbar (75 Torr) and 40 mbar (30 Torr), for example equal to 80 mbar (60 Torr), which corresponds to a first vapor equilibrium temperature $T_1$ which is approximately equal to 45° C.

An electric valve 18 for cutoff and for interrupting the vacuum is placed along the line 15 upstream of the pump 16.

According to the invention, upstream of the main vacuum pump 16 there is a secondary aspiration device, generally designated by the reference numeral 19, which is suitable to work in series to the main pump 16 when the upper value $P_s$ of the absolute pressure is reached.

In particular, the aspiration device 19 can be constituted by a vane or Roots-type blower, for example of the type manufactured and marketed by Robuschi SpA under the trademark RB/AV, with high capacities of approximately 300 to 1000 $m^3/h$, and low heads, for example 80 mbar (60 torr) to 100 mbar (75 torr).

As an alternative it is possible to use an air or steam ejector which is not shown in the drawing and is within the grasp of any technician in the field.

The blower 19 is connected in series to the main pump so that its intake duct 20 and its delivery duct 21 are always open, and runs continuously in order to make its differential pressure immediately available. Conveniently, the intake and delivery ducts 20, 21 are connected by a bypass circuit with a normally-open electric valve 22. This electric valve is operatively connected to a pressure sensor 24 which is arranged on the line 15 and is set to act on the valve 22 so that the valve is open for absolute pressure values above $P_s$, which is set for example to 80 mbar (60 Torr), and is closed when this value is reached. By virtue of the series arrangement of the blower 19 and of its continuously available high capacity, the absolute pressure in the circuit reaches, within a few moments, a lower value $P_i$ which is close to absolute vacuum. Practical tests conducted on the system show that despite the unavoidable losses along the circuit and at the covers 6 of the beds 2 the pressure reaches, in less than 10 s, a minimum value of 1 mbar (0.75 Torr) to 15 mbar (11.25 Torr), which corresponds to a second equilibrium temperature $T_2$ of the steam which is between 2 and 7° C.

Accordingly, the beds can be heated with water at temperatures $T_r$ which are between 15° C. and 30° C., are distinctly lower than those of the past, and are such as to leave the quality of the grain of the hide absolutely unchanged. Furthermore, by virtue of the extremely short evaporation times, the hide does not lose its fat content, which is essential in giving it a good texture and high softness to the touch.

Obviously, in order to allow the vapors to condense in the same time intervals it is also necessary to considerably lower the temperature $T_r$ of the water that cools the various condensers and the condensate separators and is kept at around 0° C.

Conveniently, in order to avoid low-pressure re-evaporation in the condenser 13 and in the separator 14, these devices are adequately insulated in order to function adiabatically with respect to the outside environment.

In use, the hides are laid on the lower parts of the beds 2, which are in turn closed hermetically with the covers 6. The beds 4 are then heated with water at a temperature $T_s$ which is lower than 30° C. Then the pump 16 is started, gradually decreasing the absolute pressure within a few minutes to a value $P_s$ between 100 and 40 mbar, for example 80 mbar, to which the pressure sensor 23 is set. When the pressure $P_s$ is reached, the pressure sensor activates the electric valve 22, closing the bypass circuit of the device 19. This device operates in series to the vacuum pump 16, further reducing the pressure until it reaches a degree of vacuum which is close to absolute, with residual absolute pressures of approximately 5–10 mbar. At these pressures, the vapor equilibrium temperature $T_2$ is below 10° C. and thus produces a thermal gradient at the beds which is meant to promptly vaporize the residual moisture of the hides. The vapors are quickly condensed by virtue of the temperature of the condensers, which is approximately equal to 0° C., drastically reducing the drying time.

If one wishes to give priority to low treatment temperatures, in order to dry particularly delicate and thin hides, it is possible to reduce the heating temperature $T_r$, for example to less than 20° C., slightly reducing the thermal gradient and conversely increasing the drying time. By acting on these parameters it is possible to balance the two effects, obtaining optimum quality with considerably shorter drying times than in the past.

Where technical features mentioned in any claim are followed by reference signs, those reference signs have been included for the sole purpose of increasing the intelligibility of the claims and accordingly, such reference signs do not have any limiting effect on the scope of each element identified by way of example by such reference signs.

It is claimed:

1. Vacuum apparatus for multiple-bed industrial hide driers, wherein each bed has a heating surface on which the hides to be dried are placed and a cover that provides a hermetic seal, said apparatus comprising a circuit with an open end, along which the following components are arranged in series:

at least one vapor manifold associated with each bed to collect the vapors released by the hides;

a first condenser inserted in each manifold;

at least one main vacuum pump;

wherein said main vacuum pump is suitable to gradually reduce an absolute pressure in the circuit to a first value corresponding to a first vapor equilibrium temperature, a first and a second condensate separator are arranged at an output of said condenser, a secondary aspiration device is arranged upstream of the main vacuum pump and downstream of said first and second condensate separator for dry air operation, wherein said secondary aspiration device is suitable to continuously operate in series to said vacuum pump when said first value of the absolute pressure is reached so as to further reduce the pressure of the circuit to a second, lower, value with a result of at least one of (a) instantly increasing evaporation and (b) reducing the vapor equilibrium temperature to a value which is lower than said first vapor equilibrium temperature.

2. Apparatus according to claim 1, wherein said first value of the absolute pressure reached by said main vacuum pump is between 40 mbar or 30 Torr and 100 mbar or 75 Torr.

3. Apparatus according to claim 1, wherein said second lower value of the absolute pressure reached by the series operation of said secondary aspiration device is between 15 mbar or 11.26 Torr and 1 mbar or 0.75 Torr.

4. Apparatus according to claim 1, wherein said secondary aspiration device is of the type with a high capacity and a low head.

5. Apparatus according to claim 4, wherein said secondary aspiration device has a capacity of 300 to 1000 $m^3/h$ and an average head of 30 mbar or 22.5 Torr to 100 mbar or 75 Torr.

6. Apparatus according to claim 4, wherein said secondary aspiration device is a positive-displacement compressor.

7. Apparatus according to claim 6, wherein an intake and an outlet of said secondary aspiration device are connected by a bypass circuit with a controlled electric valve.

8. Apparatus according to claim 7, wherein in operation, said secondary aspiration device runs continuously and that said electric valve of the bypass circuit is normally open for absolute pressure values of the circuit which are higher than said upper value and is closed for equal or lower values.

9. Apparatus according to claim 8, wherein the apparatus has a pressure sensor upstream of said secondary aspiration device, said sensor being operatively connected to said controlled electric valve and being set at said first value of the absolute pressure.

10. Apparatus according to claim 1, wherein the apparatus has a final vapor condenser downstream of said first condensate separator and a final condensate separator.

11. Apparatus according to claim 10, wherein the temperature of the liquid for cooling said initial and final condensate separators and condensers is close to 0° C.

12. Apparatus according to claim 11, wherein said condenser and said final separator are insulated to minimize heat exchange with the outside environment and to avoid re-evaporation of the condensate at low pressure.

13. Vacuum drier for industrial hides, comprising a series of work beds, in which each bed comprises a heating surface, on which the hides to be dried are placed to cause the evaporation of their residual moisture, and a hermetic cover, wherein each bed is connected to a vacuum apparatus according to claim 1, in such an arrangement as to reduce at least one of the time and the temperature for the evaporation of the residual moisture of the hides.

14. A vacuum apparatus for multiple-bed industrial hide driers, wherein each bed has a heating surface on which the hides to be dried are placed and a cover that provides a hermetic seal, said apparatus comprising a circuit with an open end, along which are arranged in series:

at least one vapor manifold associated with each bed to collect vapors released by the hides;

a condenser inserted in each manifold;

at least one main vacuum pump, said main vacuum pump being suitable to gradually reduce absolute pressure in the circuit to a first value corresponding to a first vapor equilibrium temperature, said apparatus further comprising:

a first and a second condensate separator arranged at an output of said condenser;

a secondary aspiration device arranged upstream of said main vacuum pump and downstream of said first and second condensate separators to operate almost exclusively on dry air, said secondary aspiration device being suitable to continuously operate in series with said vacuum pump when said first value of the absolute pressure is reached so as to further reduce the pressure of the circuit to a second value lower than said first value with a result of at least one of (a) instantly increasing evaporation and (b) reducing the vapor equilibrium temperature to a value which is lower than said first vapor equilibrium temperature.

* * * * *